United States Patent [19]

Horsewell et al.

[11] 4,364,403

[45] Dec. 21, 1982

[54] SMOKE FILTRATION

[75] Inventors: Henry G. Horsewell, Totton; John A. Luke, Romsey, both of England

[73] Assignee: British-American Tobacco Company Limited, London, England

[21] Appl. No.: 178,882

[22] Filed: Aug. 18, 1980

[30] Foreign Application Priority Data

Aug. 28, 1979 [GB] United Kingdom ..... 7929768

[51] Int. Cl.[3] ..... A24D 3/02; A24D 3/06; A24D 3/18

[52] U.S. Cl. ..... 131/332; 131/336; 131/340; 131/343; 131/345; 131/362; 131/365; 131/95

[58] Field of Search ..... 131/90–95, 131/10 R, 261, 269, 331, 332, 336, 362, 365, 340, 341, 343, 345

[56] References Cited

U.S. PATENT DOCUMENTS 3,079,978 3/1963 Cobb, Jr. et al. ..... 131/331

4,135,523 1/1979 Luke ..... 131/332

6,034,765 7/1977 Van Hall ..... 131/332

*Primary Examiner*—V. Millin

*Attorney, Agent, or Firm*—Kane,Dalsimer, Kane, Sullivan and Kurucz

[57] ABSTRACT

A rod-form body of smoke filtration material, preferably fibrous or filamentary, is wrapped in a fibrous or filamentary plugwrap comprising at least 50% by weight of fibres or filaments of thermoplastics material. The plugwrap may have premeability for air of not less than 10,000 Coresta units. The majority, suitably at least 80% by weight, of the material of the rod-form body is a material other than the said themoplastics material of the plugwrap. Thus the smoke-filtration material may comprise crimped polypropylene tow and the plugwrap be composed substantially wholly of fibrous cellulose acetate or conversely. Portions of such filter rod may be subjected to a hot-shaping process to provide grooved filter elements.

10 Claims, 1 Drawing Figure

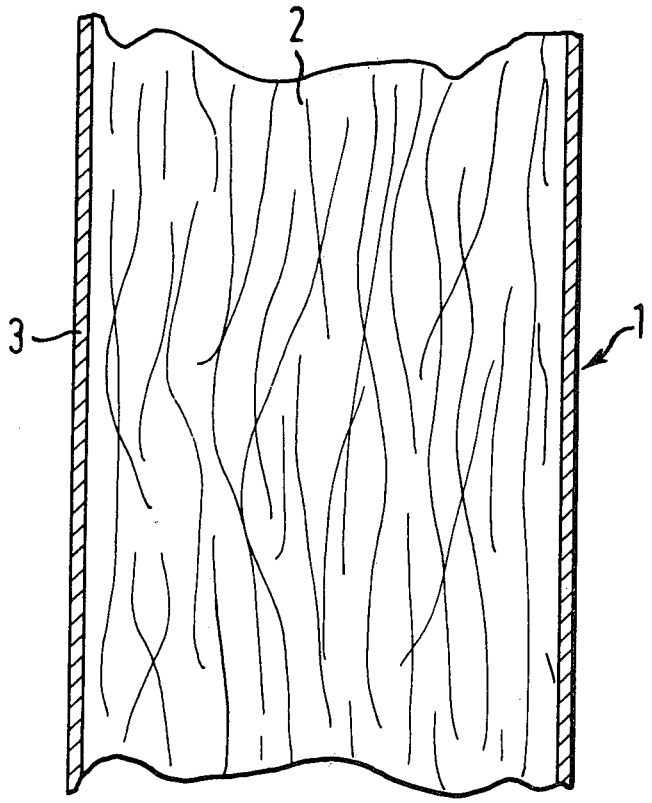
2
3
1

SMOKE FILTRATION

This invention relates to smoke filters, for tobacco smoke filtration for instance, and their production.

It is common practice to provide smoking articles, cigarettes for example, with a tobacco-smoke filter comprising a rod-form plug of fibrous filtration material, for instance cellulose acetate, paper or polypropylene which plug is wrapped in a paper plugwrap. Such wrapped filter plugs are derived from filter rod manufactured in continuous fashion on a filter-rod making machine to which are fed the filtration material, for example continuous cellulose acetate filament as a crimped tow from a bale thereof, and plugwrap in continuous strip form from a bobbin. The tow is spread and sprayed with a suitable plasticiser, such as triacetin in the case of cellulose acetate tow, and is then passed to a garniture of the making machine which operates to bring the tow to rod form and to wrap it in the plugwrap. This mode of manufacturing filter rod is the current orthodox method in the cigarette making industry.

Filter rod is also known which, instead of being provided with an enveloping plugwrap to provide stability, is made by a process which imparts a self-sustaining nature to the filtration material concerned.

The Specification of our U.S. Pat. Ser. No. 4,149,546 discloses a process and an apparatus for shaping a portion of filter rod by heat and pressure applied to said portion by moving it in a direction transverse to the longitudinal axis thereof in an arcuate path relative to a shaped heating former. The process may be employed to produce an annular groove in the rod portion and thus provide a filter element suitable for use in filters disclosed in the Specification of co-pending United States Application Ser. No. 839,297. In operating the process according to our Specification U.S. Pat. No. 4,149,546, it is convenient to employ self-sustaining filter rod, made from cellulose acetate for example.

It is an object of the present invention to provide means whereby the above mentioned filter-rod shaping process can be performed without employing self-sustaining filter rod, but which yet permits, for example, the manufacture of a grooved filter element closely similar to that obtainable when use is made of self-sustaining filter rod.

The present invention provides filter rod comprising a rod-form body comprising smoke-filtration material wrapped in a fibrous or filamentary plugwrap comprising at least 50% by weight of fibres or filaments of thermoplastics material.

In such filter rod, the aforesaid plugwrap can readily satisfy the requirements of filter ventilation as now commonly specified for cigarette filters. In this case, the plugwrap should have air permeability of not less than 10,000 Coresta units. The air permeability of sheet material in Coresta units is based on a measurement of the rate of flow, expressed in cubic centimeters per minute, of air which is caused to flow through a one square centimeter zone of the sheet material under a pressure difference across the zone of 10 centimeters of water.

The invention further provides a method of producing smoke-filter rod comprising wrapping a body of smoke-filtration material in a plugwrap comprising at least 50% by weight of fibres or filaments of thermoplastics material.

Advantageously the majority, and preferably at least 80% by weight, of the material of the rod-form body is a material other than the thermoplastics material of the plugwrap. Suitably the material of the body is of a fibrous or filamentary nature.

The body may include or be composed of, for example, cellulose acetate or polypropylene in tow or web form or in foamed form with an open cell structure, or of paper.

Preferably the plugwrap comprises not less than 80% by weight of the thermoplastics material and, advantageously, not less than 90%. The plugwrap may comprise more than one thermoplastics material. It may also include proportions of one or more non-thermoplastics materials. Cellulosic fibres may be included and the plugwrap may also contain strength-imparting additives and binders. The plugwrap may be made by a non-woven or conventional paper-making process.

It is essential that the plugwrap should possess sufficient tensile strength and be suitable in other respects for efficient running on a filter-rod making machine. Preferably the tensile breaking strength of the plugwrap should not be less than 50 g per mm of the plugwrap width.

The following are examples of ways in which the invention may be carried into effect, reference being made to the accompanying drawing which represents to a large scale a longitudinal section through a short length of filter rod from which cigarette filters are to be produced.

EXAMPLE I

Using a Hauni KDF1 filter rod making machine, filter rod 1 was produced from crimped polypropylene tow 2 constituting the smoke-filtration material and a plugwrap 3 composed substantially wholly of cellulose acetate fibres and having a permeability of about 25,000 Coresta units. The plugwrap 3 was non-woven and made by a conventional paper-making process. Its tensile breaking strength was 60 g per mm width.

When portions of the filter rod were employed in the hot-shaping process disclosed in our U.S. Pat. No. 4,149,546 to produce grooved filter elements, the quality of the elements was fully equal to that obtainable using self-sustaining filter rod.

EXAMPLE II

Again using a Hauni KDF1 machine, filter rod was made from crimped cellulose acetate tow and plugwrap formed from a fibrous non-woven polypropylene sheet material having a permeability of about 25,000 Coresta units. The tow was plasticised using triacetin and the plugwrap was lap sealed using a hot melt adhesive.

Portions of the filter rod thus manufactured were employed in the hot shaping process disclosed in our aforesaid U.S. Pat. No. 4,149,546 to produce grooved filter elements.

The polypropylene plugwrap melted under the action of the hot-shaping process and the resultant filter elements were of a quality equal to that obtained when similar elements were made by subjecting portions of unwrapped self-sustaining cellulose acetate filter rod to the same process.

What is claimed is:

1. Smoke filter rod which comprises a rod-form body comprising smoke-filtration material which has been enwrapped in a fibrous or filamentary paper-type plugwrap separate from and non-integral with the body of smoke-filtration material and comprising at least 50% by weight of fibres or filaments of thermoplastics material.

2. Filter rod according to claim 1, wherein the plugwrap has a permeability for air of not less than 10,000 Coresta units.

3. Filter rod according to claim 1 or 2, wherein the majority of the material of the rod-form body is a material other than the said thermoplastics material of the plugwrap.

4. Filter according to claim 1 or 2, wherein at least 80% by weight of the material of the rod-form body is a material other than the said thermoplastics material of the plugwrap.

5. Filter rod according to claim 1 or 2, wherein the material of the rod-form body is of a fibrous or filamentary nature.

6. Filter rod according to claim 1 or 2, wherein the plugwrap comprises at least 90% by weight of the thermoplastics material.

7. Filter rod according to claim 5, wherein the smoke-filtration material of the rod-form body comprises crimped polypropylene tow and the plugwrap is composed substantially wholly of fibrous cellulose acetate.

8. Filter rod according to claim 5, wherein the smoke-filtration material of the rod-form body comprises crimped cellulose acetate and the plugwrap is composed substantially wholly of fibrous polypropylene.

9. A method of producing smoke-filter rod comprising wrapping a body of smoke-filtration material in a paper-type plugwrap separate from and non-integral with the body of smoke-filtration material and comprising at least 50% by weight of fibres or filaments of thermoplastics material.

10. A method according to claim 9, wherein portions of the filter rod produced are subjected to a hot-shaping process to provide grooved filter elements.

* * * * *